US008840756B2

(12) United States Patent
Doublet et al.

(10) Patent No.: US 8,840,756 B2
(45) Date of Patent: Sep. 23, 2014

(54) DEVICE FOR CREATING MULTITONE WATERMARKS AND METHODS OF MANUFACTURE AND USE THEREOF

(71) Applicant: Arjowiggins Security, Boulogne-Billancourt (FR)

(72) Inventors: Pierre Doublet, Saint Brice (FR); Ivan Thierry, Jouy sur Morin (FR)

(73) Assignee: Arjowiggins Security (FR)

( * ) Notice: Subject to any disclaimer, the term of this patent is extended or adjusted under 35 U.S.C. 154(b) by 0 days.

(21) Appl. No.: 13/625,472

(22) Filed: Sep. 24, 2012

(65) Prior Publication Data

US 2013/0255896 A1 Oct. 3, 2013

Related U.S. Application Data

(63) Continuation of application No. PCT/IB2011/051226, filed on Mar. 23, 2011.

(30) Foreign Application Priority Data

Mar. 24, 2010 (FR) ..... 10 01164

(51) Int. Cl.
*D21F 11/00* (2006.01)

(52) U.S. Cl.
USPC ..... 162/141

(58) Field of Classification Search
USPC ..... 162/141, 140, 308, 110; 264/219, 154, 264/413; 428/195.1
See application file for complete search history.

(56) References Cited

U.S. PATENT DOCUMENTS

2010/0175843 A1* 7/2010 Gregarek ..... 162/140
2011/0290435 A1* 12/2011 Krul et al. ..... 162/110

FOREIGN PATENT DOCUMENTS

DE 102005042344 3/2007
DE 102006058513 6/2008
WO 2010036104 4/2010

OTHER PUBLICATIONS

English translation of International Search Report issued May 31, 2011 for corresponding International Patent Application No. PCT/IB2011/051226.
French Search Report issued Feb. 11, 2011 for corresponding French Patent Application No. FR 1001164.

* cited by examiner

*Primary Examiner* — Mark Halpern
(74) *Attorney, Agent, or Firm* — Andriy Lytvyn; Smith & Hopen, P.A.

(57) ABSTRACT

The present invention relates to the field of paper and relates to a sheet including a high-definition high-contrast multitone watermark having areas of pronounced brightness. Such watermark is particularly obtained by means of a part (4) including a surface (5) having a raised area and perforations (6). The perforations (6) are such that making the cross-section thereof, at a given distance from the draining surface, directly depends on said distance. The present invention also relates to the method for manufacturing said part that is used for forming one such watermark, to the part itself, and to the use of said part when forming a watermark.

10 Claims, 3 Drawing Sheets

DEVICE FOR CREATING MULTITONE WATERMARKS AND METHODS OF MANUFACTURE AND USE THEREOF

BACKGROUND OF THE INVENTION

1. Field of the Invention

The present invention relates to the field of paper manufacture and more particularly to a watermark. It relates to a sheet comprising a watermark and a document comprising such a sheet, the method for manufacturing a part used for forming such a watermark, the part obtained according to said method of manufacture and the use of this part during the formation of a watermark.

Watermarks are commonly used for marking documents that have a specific content or value. These are, in particular, title deeds, certificates, diplomas, banknotes, passports, identity cards, driving licenses, checks, tickets for entry to cultural or sporting events or letterhead stationery.

Watermarks are formed during the manufacture of paper, in particular by modification of the drainage of the fibrous suspension from which the paper is manufactured. Thus, a drainage fabric generally comprises flat and solid, therefore impermeable, parts commonly known as galvanos or else electrotypes. Such a part 1 is represented in FIG. 1.

By way of observation, a drainage fabric (also known as forming fabric) generally consists of at least two superposed individual fabrics.

These parts or galvanos locally modify the deposition of the fibers of said fibrous suspension with respect to the regions not equipped with said parts. The effect obtained is a light watermark that can easily be observed in transmitted light. Said watermark obtained has regions that are light, uniform, that is to say having a single level of grey, and very pronounced.

The expression "can be observed in transmitted light" is understood to mean an element (here the watermark) which is visible, especially to the naked eye, when placed between the eye of the observer and a light source so that the eye perceives the rays of the light source through the element observed.

By way of observation, the watermarks are visible in transmitted light but they are not, or not very, visible in reflection, that is to say when the eye of the observer and the light source are placed on one and same side of the element to be observed, the eye thus perceiving the rays of the light source reflecting on the element observed.

Additional technological developments have made it possible to obtain watermarks comprising several shades in levels of grey. These watermarks, known as multitone watermarks or shaded watermarks, are generally obtained by embossing of the drainage fabric 2 for example represented in FIG. 2, and in particular of at least one of the individual fabrics, preferably the upper fabric, along an embossed relief 3 composed of lowered portions 32 and raised portions 31. Such watermarks consist of regions that are lighter and regions that are darker than the non-watermarked portion (or wove paper portion) of the fibrous substrate. Said lighter and darker regions are respectively known as the lights and darks of the watermark.

Multitone watermarks are generally obtained according to the following papermaking process: a fibrous suspension comprising water and fibers, optionally added to which are fillers, in particular retention agents, opacifiers, pigments, antibacterial and/or antifungal agents, is brought into contact with said embossed drainage fabric. During the drainage, a larger amount of fibers is deposited at the lowered portions than at the raised portions, which portions are lowered or raised with respect to the planum of the drainage fabric. The "wet" sheet obtained by drainage of said fibrous suspension on said drainage fabric is subsequently pressed then dried according to the standard papermaking process. By way of observation, additional treatments may be applied in or on the sheet during its manufacture, especially via operations such as impregnations, surface applications, coating operations and/or smoothing operations. By observation in transmitted light of the watermark of the sheet thus obtained, several levels of grey are distinguished, each level of grey corresponding to a level of relief, lowering or raising, of said parts.

The manufacture of a drainage fabric comprising embossings for forming multitone watermarks requires a lot of time and is therefore very costly. This is because such a drainage fabric may, for example, comprise several hundred of said parts which must all be identical in order to enable identical watermarks to be obtained. The manufacture of said parts provided with relief consequently requires particular attention, in particular as regards their dimensions and the reproducibility of their method of manufacture.

The drainage fabric of a cylinder mold paper machine for forming watermarks generally comprises at least two superposed metallic fabrics. It is therefore sensitive to mechanical shocks. Such shocks occur in particular on the most exposed portions, for example the raised portions of an embossing. They damage the drainage fabric and thus irremediably disrupt the formation of the sheet of paper, and at least one portion of the drainage fabric, for example the outer fabric, must then be manufactured again.

Obviously, the limited service life of a drainage fabric is one of the factors influencing the total production cost of a watermarked paper.

Recently, application DE 10 2005 042 344 proposed the fact of inserting locally, at an embossing of the outer fabric of the drainage fabric, a perforated flat part that follows the relief of the embossing. The perforations of said part are microperforations. The advantage described in this application lies in the creation of multitone watermarks comprising light regions.

Application DE 10 064 006 describes how the regions of the drainage fabric comprising these perforated parts that make it possible to obtain these very light regions may be provided with additional parts by means of a shape memory material.

Applications DE 10 2006 058 513 and WO 2008/071325 describe a part used for forming watermarks. This injection-molded plastic part is provided with a relief comprising perforations made using a laser. Thus, said perforations are formed in a profiled part, that is to say a part comprising a relief on one of its faces, and starting from the face opposite the profile. According to one variant, the perforations become finer on going from the rear face (drainage fabric side) toward the profiled face. It is explained that the perforations ensure a free flow of the fibrous suspension and that the regions of said part having a greater thickness enable the formation of thin points in the paper.

One drawback of this method relates to the precision of the perforation, and in particular its diameter on the profiled face, which strongly depends on the properties of the material used, and in particular on the nature of the plastics and on the thickness of the material. The precision of the perforation is consequently difficult to control. The laser forms holes which shrink on going toward the profiled face. Due to the physical process used during the perforation of a plastic using a $CO_2$ laser, the shape of the perforation is, in the longitudinal direction of the channel, more or less conical on the side of the laser due to the Gaussian energy distribution of the laser beam, and the longer the channel is (the larger the thickness to be perforated is), the more the conical shape is reduced. The reduction of the conical shape does not make it possible to precisely control the various levels of grey in the final watermark observed in transmitted light. The use of a laser for producing the perforations does not therefore make it possible to precisely control the diameter of the perforation as a function of the height of the relief. This results in a loss of definition during the formation of the watermark.

There is a need to obtain a watermark having a better definition, a high contrast and pronounced lights, especially for increasing the security of the watermarked substrates and rendering the authentication thereof or the identification thereof easier.

The applicant therefore proposes to solve the problems of the prior art by proposing a multitone watermark according to the invention.

One subject of the invention is a sheet, in particular a security sheet, comprising a multitone watermark having a high definition, a high contrast and pronounced lights. Another subject of the invention is such a multitone watermark.

Said multitone watermark has a high level of detail, and in particular strong shades with a standard deviation of the distribution of the 8-bit coded grey levels of greater than 10, preferably of greater than 15, and/or a deviation of the 8-bit coded grey levels of greater than 120, preferably greater than 150.

The distribution of the grey levels is obtained by acquisition of the image of said multitone watermark using a scanner in transmission mode at 600 dpi.

The acquisition is carried out in particular in transparency mode (therefore in transmission mode) with a flatbed scanner and while taking the following precautions:

- colorimetric calibration according to the ICM ("Image Color Management") standard of the scanner and of the acquisition chain,
- optionally, limitation of the lighting by polarizing filter to prevent any reflections and any saturation, and
- acquisition with all corrections deactivated in order to obtain a crude signal with no retouching.

In particular, it is possible to use the EPSON® Perfection V750 Pro scanner in order to carry out this acquisition.

The limitation of the lighting by polarizing filter can be carried out by applying a filter to the acquisition zone of the scanner, in particular the glass pane of the scanner.

In particular, said multitone watermark comprises pronounced light regions, in particular that are characterized by a "maximum grey level"–"average grey level" difference of greater than 50, preferably of greater than 100, and/or a deviation of the 8-bit coded grey levels of greater than 120, preferably of greater than 150. Thus, the multitone water mark has very pronounced lights obtained without adding an additional specific part.

The multitone watermark according to the invention is preferably formed using a single part, in particular fixed to the drainage fabric.

The shades and the various levels of grey of the watermark are obtained both by the relief and by the perforations of said part used for the formation of the watermark.

The multitone watermark obtained comprises at least three different thickness values.

Said watermark also has a very good look-through, that is to say a uniform distribution of the fibers and no or few clusters of fibers (also known as "flocks"). The look-through is a measure of the formation of a sheet observed in transmitted light, it is for example measured by a 2D sheet formation sensor, in particular developed by the company TECHPAP.

In particular, the look-through of the watermark measured at a "full tone" is better than the look-through of the wove paper of the sheet containing said watermark because the formation of the watermark takes place on a part that is provided with a relief and that is perforated, and not on the drainage fabric which has a less even surface and less precise perforations since they are formed between the yarns of said drainage fabric. In this way, the multitone watermarks formed using a part that is provided with a relief and that is perforated have a better definition than the watermarks obtained by virtue of an embossing of the drainage fabric.

In particular, said watermark comprises a code formed, in positive or in negative, by a network of dark points.

Said code may be an image, an alphanumerical character, an ideogram, a symbol, a word or else initials.

Said code may be able to be observed in transmitted light with the naked eye, that is to say without a device that makes it possible to enlarge the watermark, or else using a device that makes it possible to enlarge the watermark, for example such as a magnifying glass, an image acquisition device, especially a scanner in transmission mode, or a microscope.

Said code is in particular an authentication element of the watermark and more widely of the substrate comprising it. In particular, said code may be a series number corresponding to a manufacture of paper for banknotes.

The invention also relates to a document comprising or consisting of a sheet according to the invention. Such a document is in particular chosen from title deeds, cards, certificates, diplomas, banknotes, passports, identity cards, driving licenses, checks, tickets for entry to cultural or sporting events, or letterhead stationery.

The invention extends to a method for manufacturing a part for forming a multitone watermark in a substrate by drainage of a fibrous suspension, said part comprising a relief on one of its faces referred to as the "profiled face" and opposite the "drainage face", and perforations, said perforations comprising a through-channel with an inlet on the profiled face and an outlet on the drainage face, comprising the steps consisting in forming said relief and forming said perforations on said part so that each perforation is such that the cross-sectional area of its channel at a given distance from the drainage face depends directly on said distance.

The expression "depends directly" is understood here to mean that the cross-sectional area of the channel of a perforation at a given distance from the drainage face is a function of, in particular proportional, preferably linearly, to this distance. In particular, for a part comprising a substantially flat drainage face, there is a link of proportionality between the cross-sectional area of the channel of a perforation at a given distance from the drainage face and this given distance. In this way, the drainage capacity of a perforation depends on the relative position of the relief with respect to this perforation.

Preferably, the linear variation is opposite, in other words the larger said distance, the smaller the cross-sectional area of the channel of a perforation. In other words, the cross-sectional area of the channel of a perforation decreases from the drainage face to the profiled face.

The part may comprise perforations that all have the same cross section for a given distance from the drainage face.

The thickness of the part may be variable, so that the thickness of the perforations may be variable. The perforations may all be through-perforations, that is to say that they emerge on the profiled face. As a variant, at least one portion of the perforations, or even all of the perforations, may be blind perforations, that is to say that the perforations do not reach the profiled face. The part may in particular have a thickness chosen so that the perforations cannot emerge on the profiled face.

The majority of the perforations, better all of the perforations, may have an identical cross-sectional variation as a function of the distance to the drainage face.

During the creation of a part according to the invention, the effect of the drainage on the formation of the watermark can be predicted. It is thus possible to predict the effects of the relief and those of the perforations on the formation of the watermark, and consequently to determine the relief and the perforations of a part in order to obtain a given watermark.

Said "drainage face" is preferably substantially flat. As a variant, it follows the relief of the drainage fabric.

According to one particular case of the invention, said part is metallic or ceramic.

The expression "metallic part" is understood in particular to mean a part comprising iron, nickel, copper, stainless steel, titanium, tungsten, cobalt, tin and/or alloys thereof, for example stainless steel.

According to one particular case of the invention, said method comprises at least one sintering step to which said part is subjected.

According to one particular case of the invention, the relief of the "profiled" face and the perforations are formed during the manufacture of said part, especially during one and the same step and in particular simultaneously. This makes it possible in particular not to weaken the part by subsequent perforation operations and to save time during the manufacture of said part by reducing the number of steps needed.

In particular, the manufacture of said part is thus carried out with no repeat of surface application, or piercing. These operations specifically contribute to increasing the cost of the part and are detrimental to the reproducibility of the method. However, said method must make it possible to obtain identical parts.

According to one variant of the invention, said method for manufacturing a part for the formation of a multitone watermark in a substrate by drainage of a fibrous suspension, is characterized in that said part is injection molded, said injection molding making it possible to obtain said relief and said perforations simultaneously.

In particular, said manufacturing method is a method which comprises at least the following steps:

- using a metal powder or a ceramic powder, and optionally a thermoplastic binder,
- injecting said powder, and where appropriate said binder, into a mold enabling the formation of a part comprising said relief and said perforations,
- optionally debinding said part, and
- sintering the part, that it is to say carrying out the solid-state densification thereof.

Such a method is a method for molding metals or ceramics by injection (MIM for "Metal Injection Molding" or CIM for "Ceramic Injection Molding" method) which makes it possible in particular to produce complex shapes on mechanically strong parts with very high precision and a high efficiency, and without requiring subsequent machining. Furthermore, this technology makes it possible to produce visual parts with awkward shapes that are difficult to machine and with very high surface qualities.

Said metallic powder may be chosen from the powders of iron, nickel, copper, stainless steel, titanium, tungsten, cobalt and alloys thereof, for example of stainless steel. It may be a powder of particles, the largest dimension of which is less than 50 μm, preferably between 1 and 40 μm. Preferably said metallic powder is a powder of copper alloy, of iron alloy, of tin alloy, of an alloy of stainless metals such as nickel and chromium, or of pure metal such as titanium. The copper alloys and the alloys of stainless metals have the advantage of withstanding corrosion during the production of the paper.

Said ceramic powder may especially comprise zirconia.

Said thermoplastic binder may be chosen from polyethylene (PE), polypropylene (PP), paraffin, stearic acid, polyacetal (POM) and mixtures thereof. Preferably, said thermoplastic binder is polyacetal (POM).

Said mixture may especially comprise 60% of metallic powder and 40% of plastic binder.

Mixtures of metallic or ceramic powder and of thermoplastic binder are commercially available. It may especially be the product Catamold® sold by the company BASF. Said marketed mixtures may be in the form of metal powder or metal powder granules mixed or coated with a thermoplastic binder. Said granules are ready for use by injection into a mold.

Said mold comprises an upper face and a lower face. Once the mold is closed, the inside of the upper face is provided with a relief and the lower and upper faces are connected by several "columns" which are used for forming the perforations of said part. Said columns may have a round or polygonal cross section, said cross section having an area that decreases on going from said lower face to said upper face.

The shape of the mold is substantially complementary to the shape of said part for the formation of a watermark, it being possible for differences to exist in particular due to the process used.

Whereas machining only makes it possible to produce conical or cylindrical perforations in the material and whereas a laser does not make it possible to control the shape of the perforations made, the process of molding metals by injection makes it possible to produce perforations having a polygonal cross section which have a behavior, with respect to the drainage of the fibrous suspension during the formation of the watermark, similar to that of perforations having a round cross section, for example with a polygon that comprises at least six, preferably at least ten sides, while enabling a better rigidification of the mold, the columns having a polygonal cross section being less subject to twisting and flexing phenomena.

Once the part is demolded, the objective of the debinding operation is to remove the thermoplastic binder. This operation can be carried out using a solvent (in particular removal by chemical reaction or dissolution) and/or baking (in particular removal by evaporation or destruction of the chemical bonds by catalysis), the atmospheric, temperature and pressure conditions of which may vary depending on the mixture used.

The sintering operation carried out on the debinded part is a heat treatment enabling the solid-state densification of the material. It may be carried out under a reduced atmosphere or under vacuum and at temperatures that are high but that are below the melting point of the metal used, for example above 1200° C. for certain alloys of iron and stainless metals. The sintering is accompanied by a phenomenon of dimensional shrinkage of the part, the metal densifies occupying the free spaces left by the thermoplastic binder removed during the debinding operation. This dimensional shrinkage is controlled by the operating conditions and furthermore takes place with conservation of the volume and of the reliefs. Said part may thus achieve a density close to 1, for example greater than 0.98, and it is an exact replica (the tolerances are very low, of the order of 0.03 to 0.07%) at a scale of less than 1, for example at a scale of 80%, of the inside of the mold (relief of the upper face and perforations formed by the columns included).

Since the sintering operation is under control across the time, temperature and pressure parameters, the density may be controlled and adapted to the alloys used. For example, it will be very close to 1 with powders based on titanium and between 0.8 and 1 for copper alloys.

Thus, a density of 0.8 results in the production of a porous part. This residual porosity controlled during the production gives the part filtration properties.

The optimal operating conditions, in particular the atmosphere, the temperature and the pressure, may be determined by a person skilled in the art.

The invention also extends to a mold as described previously and intended to be used for the manufacture of a part for forming a multitone watermark according to the invention, in particular by a process for molding metals or ceramics by injection.

According to another variant of the invention, said method for manufacturing a part for forming a watermark comprises at least the steps consisting in using a powder and densifying said powder, in particular metallic powder, under the action of a laser.

In particular, said method for manufacturing a part for forming a multitone watermark in a substrate by drainage of a fibrous suspension, is a method of sintering using a laser. In particular it is a selective laser melting (SLM) method or a selective laser sintering (SLS) method. Said sintering method using a laser makes it possible to form said relief and said perforations during one and the same step.

The SLM method enables the local densification of a material in powder form, by melting it under the action of a high-power laser. The material in powder form is, for example, a metallic powder.

The operating conditions for such a method may be the following:

- manufacturing chamber under a nitrogen atmosphere,
- use of an infrared (IR) laser, having, for example, a power between 50 and 100 Watts, and
- use of metals such as stainless steels or tool steels, titanium, chromium-cobalt mixtures or else aluminum.

The SLM method makes it possible to achieve a precision of ±50 μm for 100 mm, i.e. 0.05%.

Due to the precision and low tolerances of the methods described previously, especially MIM, CIM or SLM, identical parts are obtained using the same mold and consequently a very high reproducibility of the multitone watermarks formed using these parts is obtained. This precision and these low tolerances also make it possible to obtain parts with a relief having a precision between 0.03 and 0.07% and very fine perforations which may reach 0.2 mm in diameter. The watermarks formed using these parts therefore have a better resolution and also a great fineness and a great precision, in particular at the level of the details of the pattern such as the hairs on a portrait or the features of a face, that are even greater than those obtained by virtue of the prior methods.

The invention also relates to a part for forming a multitone watermark, as described previously, in a substrate by drainage of a fibrous suspension, characterized in that it comprises a relief on one of its faces referred to as the "profiled face" and opposite the "drainage face", and perforations, said perforations comprising a through-channel with an inlet on the profiled face and an outlet on the drainage face, and each perforation being such that the cross-sectional area of its channel at a given distance from the drainage face depends directly on said distance.

In particular the drainage face is substantially flat, and preferably is flat.

According to one particular case of the invention, the cross section of said perforations is oval, it is preferably a disk.

According to one particular case of the invention, said perforations have a polygonal cross section, the area of which decreases on going from the drainage face toward the profiled face. Thus, the drainage capacity is proportional to the length of the channel, that is to say of the relief, so that the further the relief is from the drainage face, the lower the drainage capacity is. This link of proportionality makes it possible to considerably facilitate the design of the relief. Thus, it is in effect easier to predict the effects of the perforations on the deposition of the fibers on said part during the drainage, and therefore to predict the pattern which will appear during observation in transmitted light of the watermark formed using said part.

Furthermore, the raised regions of the relief correspond to regions where the deposition of fibers will be low, both due to the relief, as explained previously, and due to the fact that the cross-sectional area of the channel of the perforations located in this raised region of the relief is reduced. Their drainage capacities are in effect lower than those of the perforations located in the less raised regions. This in particular has the effect of a lesser suction and consequently a smaller deposition of fibers at said raised regions. For these regions, very pronounced lights are obtained, similar to those obtained with galvanos, but which it is impossible to obtain by simple embossing of the drainage fabric.

The perforations are preferably fine enough not to let through the fibers of the fibrous suspension during the drainage thereof.

According to one particular case of the invention, the perforations are uniformly distributed. They form, for example, rows and columns respectively spaced 0.3 to 0.6 mm apart. As a variant, the perforations are distributed in a variable manner.

According to one particular case of the invention, the shape, the dimensions, the distribution and/or the position of the perforations forms, in positive or in negative, a code, in particular an image, an alphanumerical sign, an ideogram, a symbol, a word or else initials.

Said code is thus an authentication element of said part but also of a sheet comprising a multitone watermark obtained using said part. Indeed, the perforations can be observed on the watermark in the form of dark points.

According to the dimension of the perforations, the position of the perforations and consequently said code may be able to be observed in transmitted light with the naked eye, that is to say without a device that makes is possible to enlarge the watermark, or else with the aid of a device that makes it possible to enlarge the watermark, for example such as a magnifying glass, a thread counter, an image acquisition device, in particular a scanner in transmission mode, or a microscope.

Said code may constitute an authentication or identification element of the manufacturer of said part for the formation of a multitone watermark, of the manufacturer of the substrate comprising said multitone watermark, of the client or of the ordering party. Said code is non-removable and difficult to counterfeit, in particular more difficult to counterfeit than a printing.

According to one variant of the invention, said part is uniformly perforated over its entire surface, in particular along lines and columns, for example that are evenly spaced, and at least one perforation is not a through-perforation. In other words, the relief is locally higher, that is to say at a greater distance from the drainage face, than the perforations. In this way, more pronounced lights are obtained than previously, the suction being zero at the level of said at least one blind perforation. Furthermore, during the drainage, the perforations located around said at least one blind perforation attract, by suction, the fibers located above said at least one blind perforation. This has the effect of creating even more pronounced lights, and in particular lights that are more pronounced than in the case of a non-perforated part or a part that is uniformly perforated but has no blind perforations.

In one particular case of the invention, certain regions of said part for forming a watermark are devoid of perforations. The drainage is thus locally reduced and lighter regions of the watermark are obtained that contrast (in particular at constant relief) with the surrounding regions provided with perforations.

The method according to the invention also makes it possible to create very pronounced reliefs and in particular low regions positioned on the profiled face in the vicinity of high regions. This, combined with the suction of the perforations, makes it possible to obtain contrasted and highly shaded watermarks that have in particular pronounced lights close to darks.

The invention extends to the use of at least one part for forming a multitone watermark in a substrate by drainage of a fibrous suspension, said part comprising a relief on one of its faces referred to as the "profiled face" and opposite the "drainage face", and perforations, said perforations comprising a through-channel with an inlet on the profiled face and an outlet on the drainage face, the cross-sectional area of the channel of each perforation at a given distance from the drainage face depends directly on said distance. According to this use, said at least one part is fastened in or on a drainage fabric through which a fibrous suspension is drained.

In particular, said part is metallic or ceramic.

The expression "drainage fabric" is understood to mean a surface comprising openings suitable for drainage during the manufacture of the paper. Such a drainage fabric preferably comprises several superposed fabrics and in particular a support fabric comprising large openings positioned on which are fabrics comprising smaller openings. Said drainage fabric and said superposed fabrics may be woven, electroformed or consist of a perforated plate.

A drainage fabric equipped with metal parts according to the invention is less vulnerable than conventional embossed drainage fabrics, in particular with respect to mechanical shocks.

Said part may in particular be fastened to the forming fabric by welding, by adhesive bonding, by clamping or by attachment.

Preferably, said drainage fabric or at least one of said superposed fabrics is a metallic fabric. The use of metallic parts makes it possible to easily fasten said parts, in particular by welding.

The drainage of the fibrous suspension may take place by means of a fourdrinier or of a cylinder mold.

According to one particular case of the invention, the drainage fabric, and in particular at least one of said superposed fabrics, may be cut or embossed to enable the fastening of said part.

The position of said part, in particular the distance from said part to the planum of the drainage fabric which comprises it, may be chosen so as to obtain the desired average value of thickness (therefore of opacity) of the watermark. Thus, the lower the part is, the higher the average value of the thickness with respect to said part is.

In particular, the part may be placed vertically so that the profiled face, in particular the highest portions, of said part coincides with the planum of the drainage fabric. The part may, for example, jut out by less than 2 mm, preferably less than 1 mm, from the drainage fabric. In this way, the part is protected from possible mechanical damage during the formation of the watermark. Furthermore, due to the rigidity of the part, its ability to withstand a mechanical load on or in the drainage fabric will be greater than for the region of the watermark (or embossed region) of a conventional drainage fabric. The part may also be positioned below the planum of the drainage fabric.

According to one particular case of the invention, the drainage fabric may also comprise regions that enable the formation of watermarks according to the prior art. These regions enabling the formation of watermarks according to the prior art may, for example, correspond to watermarks comprising a relief that are obtained by embossing of the drainage fabric or to "screened" watermarks comprising two levels of grey such as those described in application EP 1 122 360. In particular, the regions enabling the formation of the watermarks according to the prior art and according to the invention are positioned on the drainage fabric so that the watermarks are juxtaposed or superposed. They are preferably complementary and can form one and the same pattern. The security of the sheet comprising the watermarks is improved because the method for forming the watermarks uses different technologies.

The invention will be better understood on reading the non-limiting examples and figures which follow.

EXAMPLE

A single-imprint mold, the shape of which is complementary to the shape of the desired part, is produced which comprises a relief on one of its inner faces referred to as the upper face and columns. Said columns go from the face opposite the upper face, referred to as the lower face, toward the upper face which they may or may not reach, depending on the case said columns will therefore be used for the formation, respectively, of conical through-perforations or blind perforations. The cross-sectional area of each column at a given distance from the lower face varies with said distance linearly and in the opposite direction, in other words the larger said distance, the smaller the cross-sectional area of said column.

Granules of Catamold® resins sold by BASF are introduced into a conventional injection press. These granules, constituted of metallic powder coated with a thermoplastic binder, are heated then injected into the mold described previously in order to obtain a first part.

Said part is then debinded by baking in an oven. The thermoplastic binder is thus removed.

The debinded part is then sintered by baking in an oven. This solid-state densification of the material (temperature below the melting point of the metal) via heat gives the part its final cohesion and final density, and is accompanied by a controlled shrinkage but by a conservation of the volume. In this way, the part thus obtained P2 is an exact replica at smaller scale of the shape of the mold and of the part before sintering.

Next, the image of two watermarks of dimension 3 cm×3 cm representing one and the same portrait is acquired by a scanner in transmission mode at 600 dpi. The illumination and acquisition conditions are identical for the two watermarks. The first watermark F1 was produced using an embossing of the fabric forming a certain relief. The second watermark F2 was produced using the part P2 according to the invention, the manufacture of which was described above. Said part P2 comprises on its profiled face a relief identical to that formed by the embossing of the fabric used for the first watermark F1.

The two watermarks F1 and F2 thus obtained are easily distinguishable by observation in transmitted light with the naked eye, the image of F2 has in particular a better definition, a better contrast, more pronounced lights, a better precision of the pattern and a better look-through.

Images are then obtained in 8-bit coded grey levels from 0 for black to 255 for white.

Measures of the grey level are carried out for each watermark on two regions of the portrait: the face and the hair. The measurements are, for example, carried out using the EPSON® Perfection V750 Pro scanner, in particular according to the protocol described previously.

A distribution curve of the grey levels is then established for each watermark, by counting for each of said regions, the number of pixels corresponding to each grey level. These curves make it possible to obtain the data collated in the following table:

TABLE 1

Table 1: 8-bit coded grey levels

| | Face | | Hair | |
|---|---|---|---|---|
| | F1 | F2 | F1 | F2 |
| GL average | 77.2 | 101.0 | 70.3 | 82.2 |
| GL standard deviation | 9.4 | 15.9 | 5.7 | 6.4 |
| GL min | 56 | 68 | 53 | 47 |
| GL max | 164 | 233 | 105 | 147 |
| GL (max − min) | 108 | 165 | 52 | 100 |

The watermark F2 according to the invention has an average grey level greater than the average grey level of F1. In its entirety, it is therefore lighter than the watermark F1.

The watermark F2 has a standard deviation of the grey levels greater than that of the watermark F1, it is consequently more contrasted than the watermark F1.

The watermark F2 has a deviation of the grey levels greater than the deviation of the grey levels of watermark F1, respectively for the same regions. These regions are therefore more contrasted on the watermark F2 than on the watermark F1.

The watermark F2 has a maximum grey level greater than that of the watermark F1, the lights are therefore more pronounced on the watermark F2.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
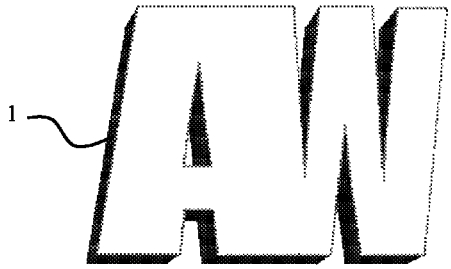
FIG. 1 (prior art)
FIG. 1 represents a galvano intended for forming a watermark according to the prior art.

According to the prior art described previously and that enables the formation of watermarks having a single grey shade, a galvano 1 as represented in FIG. 1 is fastened to the forming fabric of a papermaking machine.

Figure 2:
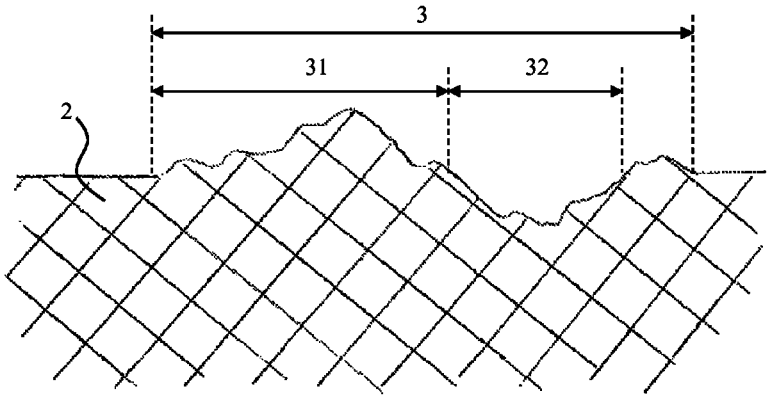
FIG. 2 (prior art)
FIG. 2 represents the embossing of a fabric for the formation of a watermark according to the prior art.

Furthermore, as described previously, it is known to emboss the forming fabric of a papermaking machine in order to produce multitone watermarks. FIG. 2 represents a fabric 2 comprising an embossed region 3 enabling the formation of a multitone watermark. The region 31 being higher than the rest of the fabric, it enables the formation of a light region of the watermark. Conversely, the region 32 enables the formation of a dark region of the watermark. Since regions 31 and 32 comprise a multi-level relief, they make it possible to obtain a multitone watermark.

Figure 3:
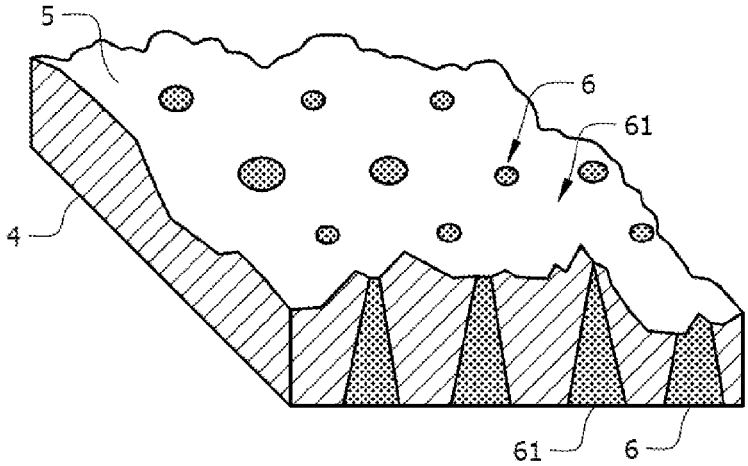
FIG. 3 represents a part that enables the production of a watermark according to the invention.

A part 4 according to the invention for forming a multitone watermark is represented schematically in FIG. 3. Said part 4 comprises a face 5 provided with a relief and conical perforations 6, and the drainage capacity of each perforation 6 depends directly on the distance to the drainage face of the cross section on the profiled face of the channel formed by said perforation 6.

Due to the relief of the face 5, the perforations 61 are not through-perforations. This in particular has the effect of enabling the formation of very light regions on the watermark.

By way of observation, depending on the method used for the manufacture of said part 4 for the formation of a watermark, and in particular for the manufacture of the mold that makes it possible to obtain said part 4, it may be easier and more practical to manufacture said mold with a lower face comprising uniformly distributed columns and with a relief on its upper face which may, locally, be higher than said columns so as to form blind perforations on the part 4. The manufacture of a mold with regions comprising uniformly distributed columns, and other regions devoid of columns, may in fact prove more complex depending on the method used.

Figure 4:
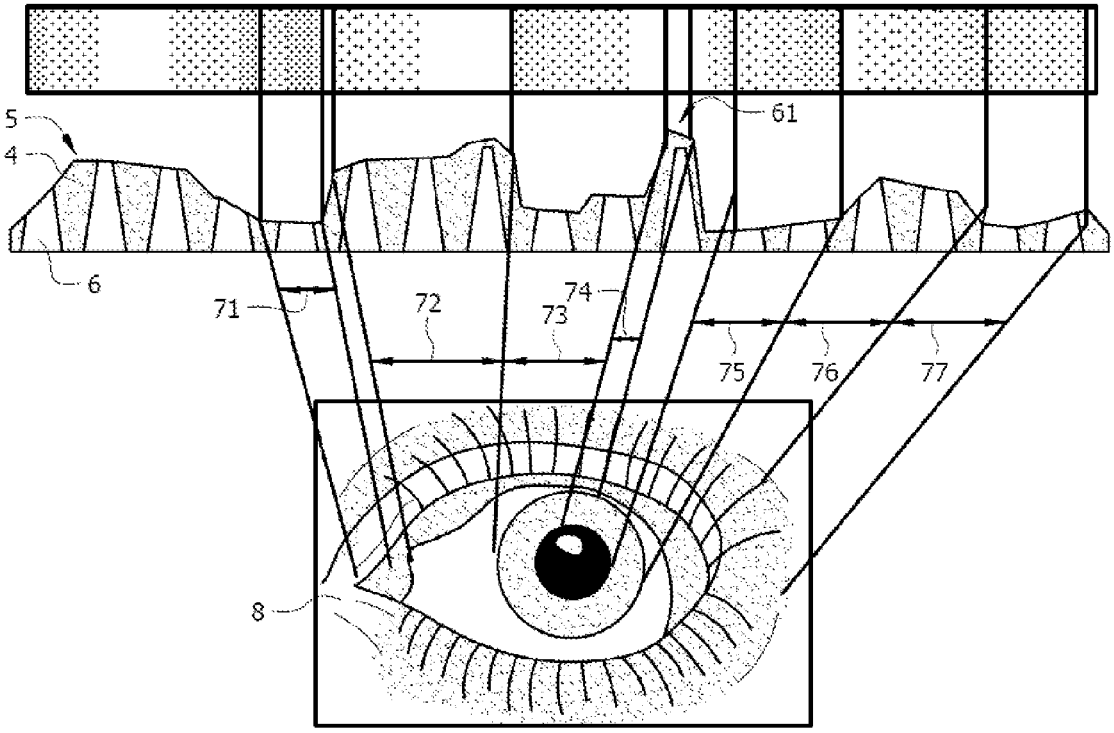
FIG. 4 illustrates the correspondence between the relief of the part used and the watermark obtained.

FIG. 4 illustrates the correspondence between a part 4 according to the invention for forming a multitone watermark and the shades of grey obtained on said multitone watermark. Said part 4 comprises a surface 5 provided with a relief and perforations 6, certain of which 61 are not through-perforations. The part 4 represented in FIG. 5 makes it possible to obtain a multitone watermark 8 according to the invention comprising several levels of grey.

The regions 71 and 73 have a low relief and consequently perforations that have a high drainage capacity, they therefore correspond to darks of the watermark 8. Region 72 has a higher relief than that of regions 71 and 73, it therefore corresponds to a region ranging from light to very light (from the left to the right) of the watermark 8. Region 74 has a high relief and a blind perforation 61 and corresponds to a very light region of the watermark. The method according to the invention which is used for manufacturing the part 4, due to its precision, makes it possible to obtain "abrupt" reliefs which are expressed on the watermark by the presence of very light regions, such as region 74, directly adjacent to very dark regions, such as region 73. In the same way as above, region 76 corresponds to a light of the watermark placed between two darks corresponding to regions 75 and 77. The regions 71, 75 and 77 enable the formation of very dark regions on the watermark 8 because beyond the hollow formed by the relief of the face 5, the perforations are larger in these regions therefore the drainage is greater. This results in a greater densification of the fibrous mat being formed and consequently the formation of dark regions.

Figure 5:
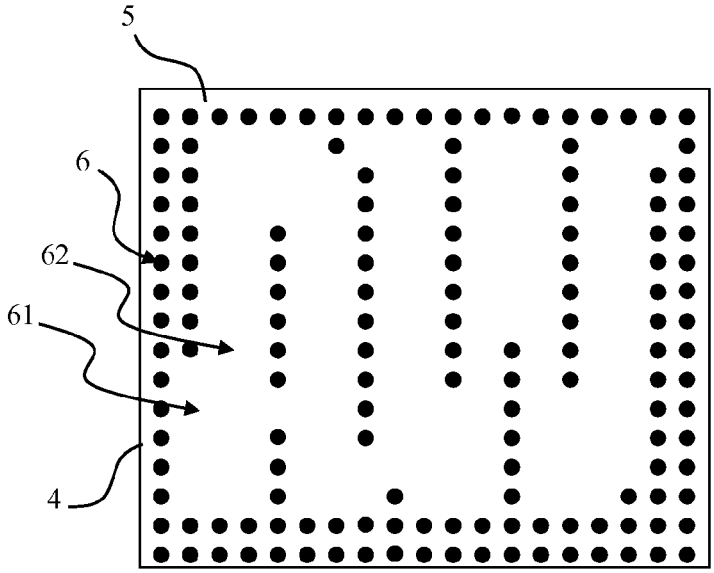
FIG. 5 represents a code in negative formed by the perforations.

The position and distribution of the perforations 6 at the surface of the "profiled" face 5 of the part 4 according to the invention may make it possible to form a code 62. FIG. 5 is a top view of such a part 4, it reveals the code 62 "AW" in negative. This code may be produced by means of blind perforations 61 positioned according to the code 62 or by the fact that the part 4 does not possess perforations on the region forming the code 62.

According to one variant that is not represented, the code 62 may be formed by perforations that each have a cross section on the "profiled" face 5 of area A1 whereas outside of the region defined by the code 62, the "profiled" face 5 is provided with perforations that each have a cross section of area A2 greater than A1. The proportional ratio between A1 and A2 is in particular chosen so as to make visible, for example under observation in transmitted light with a magnifying glass with 5 enlargement, said code 62.

Figure 6:
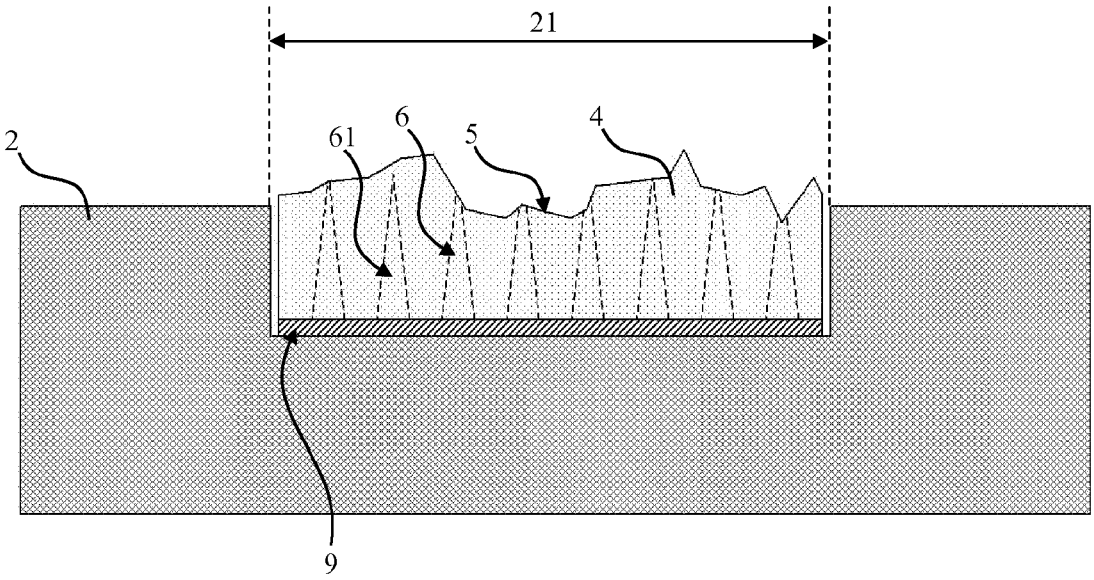
FIG. 6 represents a part according to the invention on a forming fabric.

A part 4 according to the invention is represented in FIG. 6. It may in particular be welded via a weld 9 to an embossed region 21 of the drainage fabric 2. This part 4 comprises a "profiled" face 5, perforations 6 and blind perforations 61.

The expression "having a" or "comprising a" should be understood as being synonymous with "having at least one" or "comprising at least one", unless otherwise specified.

What is claimed is:

1. A method of manufacturing a device for creating multitone watermarks in a substrate by drainage of a fibrous suspension, said device comprising a body having a profiled surface and a drainage surface, said surfaces being opposite, a relief on the profiled surface, and a plurality of perforations within the body, each perforation comprising a through-channel with an inlet on the profiled surface and an outlet on the drainage surface, the method comprising the steps of:

forming said relief on said profiled surface;

forming said plurality of perforations within said body, wherein the cross-sectional area of the through-channel at a given distance from the drainage surface is a function of the distance from the cross-sectional location to the drainage surface; and subjecting said device for creating watermarks during manufacture to an at least one sintering step.

2. The method as claimed in claim 1, further comprising said device for creating multitone watermarks being metallic or ceramic.

3. The method as claimed in claim 2, further comprising said metallic device for creating multitone watermarks being injection molded.

4. The method as claimed in claim 1, wherein said at least one sintering step is a laser sintering step.

5. The method as claimed in claim 4, wherein said laser sintering step is a selective laser melting method.

6. The method as claimed in claim 4, wherein said laser sintering step is a selective laser sintering method.

7. The method as claimed in claim 1, further comprising the relief on the profiled surface and the plurality of perforations being formed simultaneously.

8. The method as claimed in claim 1, further comprising injecting a metal powder or a ceramic powder into a mold to form said relief and said plurality of perforations.

9. The method as claimed in claim 8, further comprising utilizing a laser to densify said powder.

10. The method as claimed in claim 8, further comprising the steps of:

injecting a thermoplastic binder into a mold to form said relief and said plurality of perforations within said body;

debinding said body; and sintering said body to achieve said device for creating multitone watermarks.

* * * * *